US008284156B2

(12) United States Patent
Miyamoto

(10) Patent No.: US 8,284,156 B2
(45) Date of Patent: Oct. 9, 2012

(54) ELECTROPHORETIC DISPLAY DEVICE EMPLOYING ORGANIC THIN FILM TRANSISTORS, DRIVING METHOD FOR DRIVING CIRCUITS OF THE ELECTROPHORETIC DISPLAY DEVICE, AND ELECTRONIC APPARATUS INCLUDING THE ELECTROPHORETIC DISPLAY DEVICE

(75) Inventor: Tsutomu Miyamoto, Shiojiri (JP)

(73) Assignee: Seiko Epson Corporation (JP)

( * ) Notice: Subject to any disclaimer, the term of this patent is extended or adjusted under 35 U.S.C. 154(b) by 749 days.

(21) Appl. No.: 12/034,057

(22) Filed: Feb. 20, 2008

(65) Prior Publication Data

US 2008/0204435 A1 Aug. 28, 2008

(30) Foreign Application Priority Data

Feb. 28, 2007 (JP) ..... 2007-048913

(51) Int. Cl.
*G09G 3/34* (2006.01)

(52) U.S. Cl. ..... 345/107
(58) Field of Classification Search ..... 345/107
See application file for complete search history.

(56) References Cited

U.S. PATENT DOCUMENTS

2002/0036616 A1* 3/2002 Inoue ..... 345/107
2005/0146775 A1* 7/2005 Chung et al. ..... 359/296
2006/0209011 A1* 9/2006 Miyasaka ..... 345/107

FOREIGN PATENT DOCUMENTS

JP 2004-094168 3/2004
JP 2004325489 A * 11/2004

OTHER PUBLICATIONS

Machine translation of JP 2004-325489 obtained from JPO website Ukigaya Nobutaka.*

* cited by examiner

*Primary Examiner* — Chanh Nguyen
*Assistant Examiner* — Sanghyuk Park
(74) *Attorney, Agent, or Firm* — Harness, Dickey & Pierce, P.L.C.

(57) ABSTRACT

A display device includes a pixel electrode and a counter electrode facing each other, a plurality of charged particles disposed between the pixel electrode and the counter electrode, an organic transistor electrically connected to the pixel electrode, a data line electrically connected to the pixel electrode via the organic transistor, a data line driving circuit supplying an image signal to the data line, and a counter electrode driving circuit supplying a counter electrode driving signal containing a pulse signal having the same polarity as the image signal to the counter electrode.

6 Claims, 8 Drawing Sheets t1<t<t2 t2<t<t3

WHEN SELECTING GATE, NO-WRITE OPERATION PIXEL

WHEN SELECTING GATE, WRITE OPERATION PIXEL

ELECTROPHORETIC DISPLAY DEVICE EMPLOYING ORGANIC THIN FILM TRANSISTORS, DRIVING METHOD FOR DRIVING CIRCUITS OF THE ELECTROPHORETIC DISPLAY DEVICE, AND ELECTRONIC APPARATUS INCLUDING THE ELECTROPHORETIC DISPLAY DEVICE

BACKGROUND

1. Technical Field

The present invention relates to a display device including an organic transistor, a driving method of a display device, and an electronic apparatus.

2. Related Art

Organic semiconductors are promising future semiconductors succeeding silicon and compound semiconductors and their wide application to various electronic apparatuses are expected. In particular, development of the organic semiconductors has led to realization of thin, light and flexible devices which can be freely bent and also to realization of production of electronic price label (information tag) that can enable individual products to be managed in wireless, so research and development on practical use of the organic semiconductors are progressing. For example, a flexible display represented by electronic paper can serve as an electronic apparatus which bears a part of ubiquitous society thanks to its advantages of the ability of shock absorption and the pliability which adapts itself to a hand in addition to lightness fitted for carrying. As such a flexible display, things using an electric electrophoresis phenomenon and things using Electro Liquid Powder (registered trademark of Bridgestone Corp.) which is disclosed in JP-A-2004-94168 are known.

However, it is known that on-resistance of an organic transistor is high compared with the transistors using amorphous silicon or polysilicon. That is, under the present circumstances, the performance necessary for a switching element is not obtained by the organic transistor. The on-off ratio of a general organic transistor is about $10^3$ to $10^5$, and is markedly low compared with an amorphous silicon transistor. For this reason, when the number of scanning lines is increased, it happens that a voltage, which originally must not be applied, is applied to a pixel electrode due to the off-current (leak current in an OFF state) of an organic transistor, leading to deterioration of contrast and occurrence of cross talk.

SUMMARY

An advantage of some aspects of the invention is that it provides a display device and a driving method thereof, which are capable of preventing lowering of contrast and occurrence of cross talk attributable to the off-current of an organic transistor. Further advantage of some aspects of the invention is that it provides an electronic apparatus including such a display device and having high flexibility and excellent display quality.

According to one aspect of the invention, there is provided a display device including a pixel electrode and a counter electrode facing each other, a plurality of charged particles disposed between the pixel electrode and the counter electrode, an organic transistor electrically connected with the pixel electrode, a data line electrically connected with the pixel electrode via the organic transistor, a data line driving circuit which supplies an image signal to the data line, and a counter electrode driving circuit which supplies a counter electrode driving signal containing a pulse signal having the same polarity as the mage signal to the counter electrode.

According to this aspect, the pulse signal having the same polarity as the image signal is supplied to the counter electrode. Accordingly, even if the off-current flows through the organic transistor, it is possible to draw the charged particles in a direction which is opposite to a direction in which the charged particles move by the off-current. Accordingly, although the charged particles move to a position which is different from a position where the charged particles must essentially exist due to the off-current of the organic transistor, it is possible to detain and withhold the charged particles at the position where the charged particles must exist by the pulse signal. In this case, movement of the charged particles in pixels whose organic transistors are in an ON state is suppressed. However, in the display device using the charged particles, although the image signal is not continuously supplied, the charged particles can continuously move as long as electric field is formed by charges accumulated in the pixel electrode. Accordingly, even if supply of the image signal is temporarily suspended by the pulse signal, the movement of the charged particles may not be perfectly inhibited. As described above, according to this aspect, undesirable movement of the charged particles in the pixels whose organic transistors are in an OFF state is prevented. Accordingly, it is possible to provide a display device having excellent display quality.

Here, a term "a pulse signal having the same polarity as an image signal" means that a pulse signal and an image signal have the same polarity with respect to a predetermined reference potential (for example, ground potential). For example, when an image signal has a positive potential with respect to a reference potential, a pulse signal also has a positive potential with respect to the reference potential. Conversely, when an image signal has a negative potential with respect to a reference potential, a pulse signal also has a negative potential with respect to the reference potential.

A term "charged particles" means minute particles charged in positive or negative. Examples of the charged particles are electrophoresis particles and Electro Liquid Powder (registered trademark of Bridgestone Corp.). The charged particles are drawn near so as to be disposed on one electrode by the electric field formed between the pixel electrode and the counter electrode. Accordingly, a film of the charged particles is formed on the surface of the electrode, and thus the color of the charged particles is displayed. As the charged particles, one kind of charged particles or at lest two kinds or charged particles are used. For example, monochrome display can be performed by using white and black charged particles which are oppositely charged in polarity. The charged particles may be disposed between the pixel electrode and the counter electrode, but alternatively they may be enclosed inside a microcapsule together with a dispersion medium in a sealed manner.

In the display device and the driving method according to these aspects, it is preferable that amplitude of the image signal is the same as that of the pulse signal. As mentioned above, the pulse signal has force which resists against influence of the electric field formed attributable to the off-current of the organic transistor and has force of detaining the charged particles in the position where the charged particles must exist essentially. Therefore, the amplitude of the pulse signal must just be bigger than the voltage generated by the off-current of the organic transistor. However, if the amplitude of the pulse signal becomes bigger than the amplitude of the image signal, the charged particles will be applied with force in a direction opposite to a direction in which the charged particles will move by the influence of the image signal even in pixels whose organic transistors are in an ON state. Therefore, it is desirable that the amplitude of the pulse signal is the same as or less than the amplitude of the image signal. In particular, the condition in which the amplitude of the pulse signal is the same as the amplitude of the image signal is desirable for the pixels whose organic transistors are in an OFF state because such condition can most effectively suppress undesirable movement of the charged particles in the pixels in an OFF state.

In the display device, it is preferable that the pulse width of the pulse signal differs from an interval between pulses of the pulse signal. As mentioned above, the pulse signal supplied to the counter electrode and a signal attributable to the off-current supplied to the pixel electrode are offset and thus the force in a direction opposite to a direction in which the charged particles may move in the pixels whose organic transistors are in an ON state is applied to the charged particles in the pixels whose organic transistors are in an OFF state. Accordingly, the pulse signal with a larger pulse width is effective in suppressing undesirable movement of the charged particles. On the other hand, the pulse signal supplied to the counter electrode and the image signal supplied to the pixel electrode are offset with respect to the pixels whose organic transistors are in an OFF state. Accordingly, it is effective to extend the interval between pulses, the period in which the pulse signal is not supplied, in improving write speed of an image in such pixels. As described above, whichever the pulse width of the pulse signal and the interval between the pulses of the pulse signal is set too large, such setting is unsuitable as a display, and it is necessary to set up the amplitude of the pulse signal and the interval between the pulses suitably according to desired level of contrast and the write speed of an image.

For example, in cases in which the organic transistor is a P-channel transistor, in the pixel which performs write operation (whose organic transistor is in an ON state), a gate bias of the organic transistor is defined by a potential difference between a ground potential and a potential applied to a source thereof. Accordingly, it is possible to control the gate bias at a predetermined level. On the other hand, in the pixel which does not perform write operation (whose organic transistor is in an OFF state), since the gate bias of the organic transistor is defined by a potential difference between a ground potential and a potential attributable to charges accumulated in the pixel electrode, the gate bias changes according to the charges accumulated in the pixel electrode. For this reason, the average of the gate biases of the organic transistors of the pixels which do not perform write operation is relatively small, and thus it is possible to adjust the pulse width of the pulse signal so as to be larger than the interval between the pulses of the pulse signal, according to the decreased gate bias. Such situation is also applied to the case in which the organic transistor is an N-channel transistor. Even as for the N-channel organic transistor, it is preferable that the pulse width of the pulse signal is larger than the interval between pulses of the pulse signal, which can lead to provision of a display device having excellent display quality.

In the display device, it is preferable that the display device further includes a scan line electrically connected with the pixel electrode via the organic transistor and a scan line driving circuit which supplies a scan signal to the scan line, in which the counter electrode driving circuit supplies one pulse or at least two pulses to the counter electrode during a period in which one scan signal is supplied. Thanks to such a structure, it is possible to decrease moving distance by which the charged particles move due to the off current of the organic transistor, which can lead to provision of a display device having high contrast.

In the display device, it is preferable that the scan line driving circuit performs scan operation with respect to the scan line a plurality of times within a period of one frame. Thanks to such a structure, it is possible to decrease scan time for each scan operation. Accordingly, it becomes possible to decrease influence of the charge trap which was a problem in the field of the organic transistors. That is, as for the organic transistors, it is known that a phenomenon called charge trap that current which flows through a transistor decreases as time passes due to migration of opposite charges from a gate electrode to a channel region exists. Since the opposite charges generated by the charge trap is reduced as time passes, it is possible to suppress influence of the charge trap to the minimum by decreasing the scan time for each scan operation and thereby increasing the number of times of scan operations with respect to the scan line.

According to another aspect of the invention, there is provided a driving method of a display device in which a plurality of charged particles is disposed between a pixel electrode and a counter electrode and an image is displayed by moving the charged particles by electric field formed between the pixel electrode and the counter electrode, the driving method including supplying a pulse signal having the same polarity as an image signal to the counter electrode upon supplying the image signal to the pixel electrode via an organic transistor and making the charged particles move in a direction opposite to a direction in which the charged particles move in response to the image signal with respect to pixel electrodes in pixels other than pixels whose organic transistors are in an ON state. With the driving method, the pulse signal having the same polarity as the image signal is supplied to the counter electrode. Accordingly, even if the off current flows through the organic transistor, it is possible to draw the charged particles in a direction opposite to a direction in which the charged particles would move due to the off current. For this reason, although the charged particles move to a position which is different to a position where the charged particles must exist essentially by the off current of the organic transistor, it is possible to detain the charged particles in the position where the charged particles must exist essentially by the influence of the pulse signal. In this case, movement of the charged particles is suppressed in the pixels whose organic transistors are in an ON state. However, the charged particles can continuously move in the display device using the charged particles as long as the electric field is formed by the charges accumulated in the pixel electrode. For this reason, even if supply of the image signal is temporarily suspended by the pulse signal, there is no likelihood that movement of the charged particles is perfectly inhibited. According to this aspect, it is possible to prevent the charged particles from undesirably moving to the pixel electrode in association with the organic transistor which is in an OFF state and thus it is possible to provide a display device having excellent display quality.

According to a further aspect of the invention, there is provided an electronic apparatus including the display device according to the above-mentioned aspect. According to this aspect, since the electronic apparatus employs the organic transistor as a pixel switching element, the electronic apparatus can be realized by using a flexible substrate such as plastic substrate. As a result, an electronic apparatus having excellent display quality can be realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings. Such embodiments represent some aspects of the invention, but do not limit the invention. In the following embodiments, the shapes and the combinations of components are exemplarily illustrated and thus changes can be made thereto on the basis of design requirements within the scope of the invention without departing from the spirit of the invention.

First Embodiment

Figure 1:
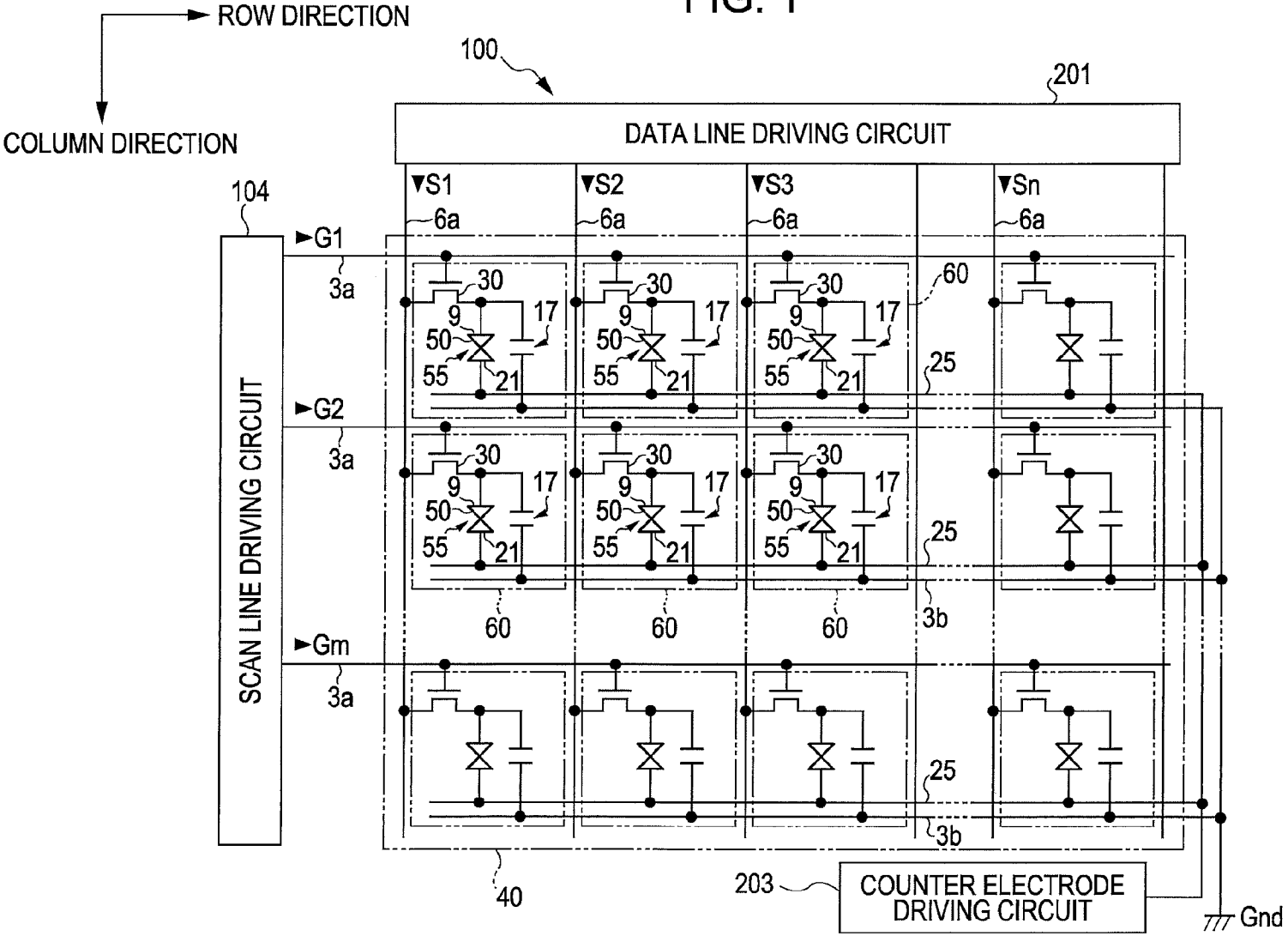
FIG. 1 is a circuit diagram illustrating an equivalent circuit of an electrophoresis device which is an example of a display device.

FIG. 1 is a block diagram showing an electrical structure of an electrophoresis device 100 which is one embodiment of a display device of the invention. The electrophoresis device 100 according to this embodiment is an active matrix type electrophoresis display device employing organic thin film transistors (TFT) as pixel switching elements. The electrophoresis device 100 can be applied to a flexible electronic apparatus such as electronic paper.

The electrophoresis device 100 includes a plurality of scan lines 3*a* each extending in a row direction (horizontal direction), a plurality of data lines 6*a* each extending in a column direction (vertical direction), and a plurality of capacitor lines 3*b* each extending in parallel with the scan lines 3*a*. Every intersection of the scan lines 3*a* and the data lines 6*a* is provided with a pixel 60 which is the unit of display. The pixels 60 are arranged in the row direction and the column direction along the scan lines 3*a* and the data lines 6*a*. A display region 40 in the rectangular is constituted by a plurality of pixels 60.

Each of the pixels 60 includes a pixel electrode 9, a thin film transistor (TFT) 30, a counter electrode 21, an electrophoresis layer 50, and a storage capacitor 17. The TFTs 30 are P-channel type organic transistors using an organic semiconductor material. Gates of the TFTs 30 are electrically connected with the scan lines 3*a*; respectively extending from a scan line driving circuit 104. Further, scan signals $G_1$, $G_2$, . . . , and $G_m$ which are in a pulse form and supplied to the scan lines 3*a* from the scan line driving circuit 104 at predetermined timings, are sequentially applied to the gates of the TFTs 30 in this order. Drains of the TFTs 30 are electrically connected with the corresponding pixel electrodes 9. Sources of the TFTs 30 are electrically connected with the corresponding data lines 6*a* extending from the data line driving circuit 201 and are applied with image signals $S_1$, $S_2$, . . . , and $S_n$ which are in a pulse form and are supplied from the data line driving circuit 201 to the data lines 6*a* at predetermined timings. In this embodiment, the image signals $S_1$ to $S_n$ are sequentially supplied to the data lines 6*a* line by line at a time but alternatively may be supplied group by group at a time, each group including a plurality of data lines 6*a* adjacent to one another.

The counter electrode 21 is disposed on the pixel electrodes 9 so as to face the pixel electrodes 9. The electrophoresis layer 50 is disposed between the pixel electrodes 9 and the counter electrode 21. Further, a pixel capacitor 55 is constituted by the pixel electrode 9, the electrophoresis layer 50, and the counter electrode 21. The counter electrode 21 is formed across the entire display region and serves as a shared electrode for all the pixels. The counter electrode 21 is electrically connected with counter electrode wiring 25 extending from the counter electrode driving circuit 203 and is configured so as to receive a counter electrode signal COM from the counter electrode driving circuit 203 at predetermined timings. The storage capacitors 17 are disposed in parallel with the pixel capacitors 55. One electrodes of the storage capacitors 17 are electrically connected with respective capacitor lines 3*b* and the capacitor lines 3*b* are maintained at a constant potential, for example at a ground potential Gnd.

As for the pixels 60, when the TFTs 30 are turned on and remain in an ON state for a predetermined period by the input of the scan signals $G_1$, $G_2$, . . . , and $G_m$, the image signals $S_1$, $S_2$, . . . , and $S_n$ are written in the pixel electrodes 9 at predetermined timings. The counter electrode 21 is supplied with the counter electrode signal COM containing the pulse signal having the same polarity as the image signals $S_1$, $S_2$, . . . , and $S_n$ via the counter electrode wiring 25. The electric field is formed between the counter electrode 21 and the pixel electrodes 9 and this makes the electrophoresis particles in the electrophoresis layer 50 migrate. Thanks to the migration of the electrophoresis particles caused due to the electric field, a gradation display is achieved. The image signals $S_1$, $S_2$, . . . , and $S_n$ having a predetermined level which are written in the pixel electrodes 9 are maintained for a predetermined period due to the pixel capacitors 55 and the storage capacitors 17.

Figure 2:
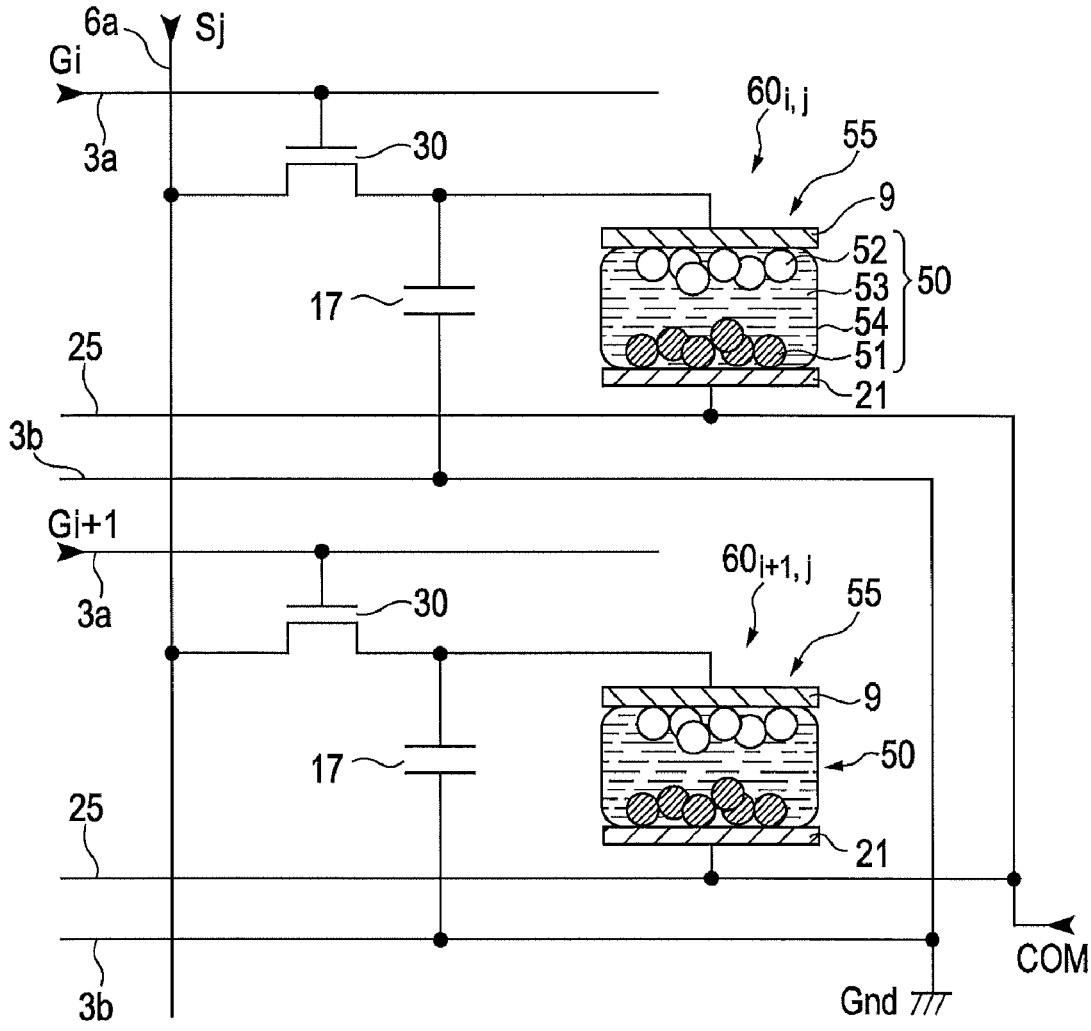
FIG. 2 is a circuit diagram illustrating an equivalent circuit of two pixels connected to a shared data line.

FIG. 2 shows an equivalent circuit of two pixels 60 ($\mathbf{60}_{i,j}$ and $\mathbf{60}_{i+1,j}$) adjacent to one another with the scan line 3*a* disposed in between. The pixel $\mathbf{60}_{i,j}$ means a pixel connected with an i-th row of scan line 3*a* and a j-th column of data line 6*a*, and the pixel $\mathbf{60}_{i+1,j}$ means a pixel connected with an i+1-th row of scan line 3*a* and a j-th column of data line 6*a*.

Each of the pixels $\mathbf{60}_{i,j}$ and $\mathbf{60}_{i+1,j}$ includes a pair of electrodes 9 and 21 which face each other and an electrophoresis layer 50 interposed between the pair of electrodes 9 and 21. The electrophoresis layer 50 includes an electrophoresis dispersion liquid in the form in which a plurality electrophoresis particles (charged particles) 51 and 52 is dispersed in a dispersion medium 53, and a microcapsule 54 encasing the electrophoresis dispersion liquid therein. The electrophoresis particles 51 and 52 are minute particles which are made of an inorganic oxide such as $TiO_2$ or an inorganic hydroxide and which have a grain size of about 0.01 to 10 micrometers. The surface charge density of the electrophoresis particles 51 and 52 is controlled by hydrogen-ion exponent pH of the dispersion medium 53. The electrophoresis particles 51 and 52 migrate by the electric field formed between the pixel electrode 9 and the counter electrode 21 and display a color by sticking to the surface of one electrode of the pair of electrodes. In this embodiment, the electrophoresis particles 51 and 52 consist of two kinds of particles, white particles and black particles. Thus, as either one kind of particles of the two kinds particles migrate toward the electrode on the display side (the counter electrode 21), the color of white or black is displayed. However, a displaying method of the electrophoresis layer is not limited thereto. For example, it can be considered a case in which the electrophoresis particles consist of one kind of particles (white particles or black particles), and the color of white or black is displayed by differently setting the color of the particles and the color of the dispersion medium.

The pixel $\mathbf{60}_{i,j}$ and the pixel $\mathbf{60}_{i+1,j}$ are electrically connected with the shared data line 6*a*. The pixel $\mathbf{60}_{i,j}$ and the pixel $\mathbf{60}_{i+1,j}$ are supplied with scan line signals $G_i$ and $G_{i+1}$, respectively in turn from different scan lines 3*a*, respectively for respective horizontal scan periods. Further, the pixel $\mathbf{60}_{i,j}$ and the pixel $\mathbf{60}_{i+1,j}$ are supplied with the image signal $S_j$ in turn from the shared data line 6*a* for respective vertical periods within one horizontal period. Yet further, the pixel $\mathbf{60}_{i,j}$ and the pixel $\mathbf{60}_{i+1,j}$ are supplied with the counter electrode signal COM, which is common for the pixel $\mathbf{60}_{i,j}$ and the pixel $\mathbf{60}_{i+1,j}$, from the counter electrode wiring 25. Thus, the electric field is formed between the pixel electrode 9 and the counter electrode 21 by the potential difference between the image signal $S_j$ and the counter electrode signal COM. The direction of the electric field changes according to the potential difference between the potential of the pixel electrodes 9 and the potential of the counter electrode 21. In this embodiment, the black electrophoresis particles 51 are charged in positive (+) and the white electrophoresis particles 52 are charged in negative (−). Accordingly, in the case in which the potential of the image signal $S_j$ supplied to the pixel electrode 9 is higher than the potential of the counter electrode signal COM supplied to the counter electrode 21, the black electrophoresis particles 51 move to the counter electrode 21 while the white electrophoresis particles 52 move to the pixel electrode 9. Accordingly, films of electrophoresis particles are formed on surfaces of the electrodes, respectively, and thus display of the color of white or black is performed. According to this embodiment, the counter electrode 21 is disposed on the display side of the electrophoresis device. Accordingly, in this embodiment, the color of black is displayed on the electrophoresis device by the black electrophoresis particles 51 sticking to the surface of the counter electrode 21.

The pixel $\mathbf{60}_{i,j}$ and the pixel $\mathbf{60}_{i+1,j}$ are supplied with the image signal $S_j$ in turn during respective horizontal periods. If the scan signal $G_i$ is supplied to the i-th row of scan line 3*a* in a predetermined horizontal period, the TFT 30 of the pixel $\mathbf{60}_{i,j}$ is turned on and the image signal $S_j$ is supplied to the pixel $\mathbf{60}_{i,j}$ for only a single vertical period. When one horizontal period ends, supply of the scan signal $G_i$ to the i-th row of scan line 3*a* is stopped, and the TFT 30 of the pixel $\mathbf{60}_{i,j}$ is turned off. After the supply of the scan signal $G_i$ to the i-th row of scan line 3*a*, the scan signal $G_{i+1}$ is supplied to the i+1-th row of scan line 3*a* and thus the TFT 30 of the pixel $\mathbf{60}_{i+1}$ is turned on. Then, the image signal $\mathbf{60}_j$ is supplied to the pixel $\mathbf{60}_{i+i,j}$ only for a single vertical period. After one horizontal period ends, supply of the scan signal $G_{i+1}$ to the i+1-th row of scan signal 3*a* is stopped, and thus the TFT 30 of the pixel $\mathbf{60}_{i+1,j}$ is turned off. While the image signal is supplied to the pixel $\mathbf{60}_{i+1,j}$, the TFT 30 of the pixel $\mathbf{60}_{i,j}$ stays in an OFF state. Accordingly, there is no possibility that the image signal that should be supplied to the pixel $\mathbf{60}_{i+1,j}$ is supplied to the pixel $\mathbf{60}_{i,j}$. The image signal $S_j$ supplied to the pixel $\mathbf{60}_{i,j}$ and the pixel $\mathbf{60}_{i+1,j}$ is maintained at a predetermined level thanks to the pixel capacitor 55 and the storage capacitor 17, and thus the display state is maintained until a next TFT 30 is turned on. By repeatedly performing such operation with respect to the first row to the m-th row of the pixels, all the pixels 60 are supplied with the image signal.

Figure 3:
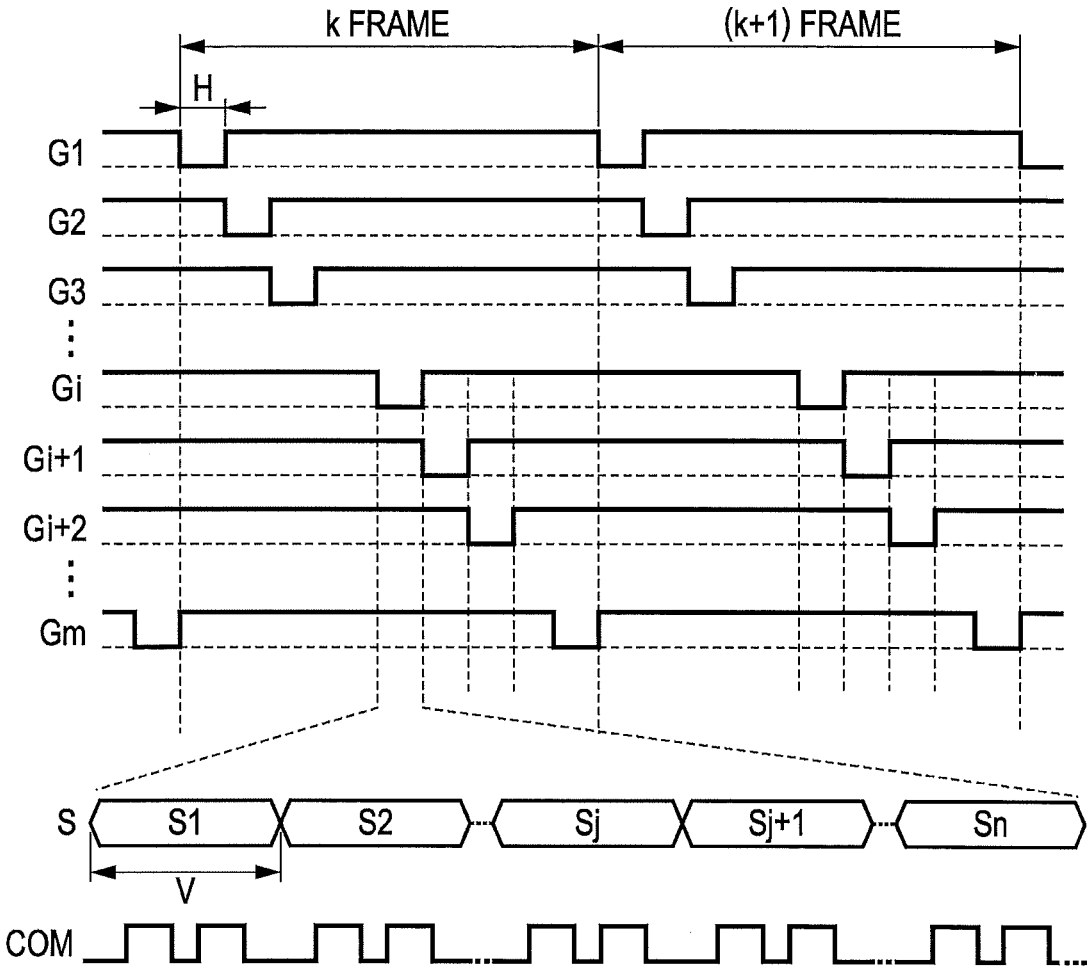
FIG. 3 is a timing charge illustrating a driving voltage according to a first embodiment of the invention.

FIG. 3 is a timing chart showing driving voltages of the electrophoresis device 100. In a display mode, a transmission start pulse is supplied at an early stage of an image write period, and the scan signals $G_1$, $G_2$, $G_3$, . . . , $G_i$, $G_{i+1}$, $G_{i+2}$, . . . , and $G_m$ are sequentially and exclusively become low level (L level) in respective horizontal scan periods H. Further, image signals $S_1$, $S_2$, . . . , $S_j$, $S_{j+1}$, $S_{j+2}$, . . . , and $S_n$ are supplied to the data lines in synchronization with the timings of the supply of the scan signals $G_1$, $G_2$, $G_3$, . . . , $G_i$, $G_{i+1}$, $G_{i+2}$, . . . , and $G_m$. Still further, the counter electrode 21 is supplied with the counter electrode signal COM containing the pulse signal having the same polarity as the mage signals, and display is performed by the potential difference between the image signals and the counter electrode signal COM. The pulse signal is supplied a plurality of times in a single vertical period V. In this embodiment, the pulse signal is supplied two times in a single vertical period V. However, the number of times of supply of the pulse signal is not limited thereto.

Figure 4A:
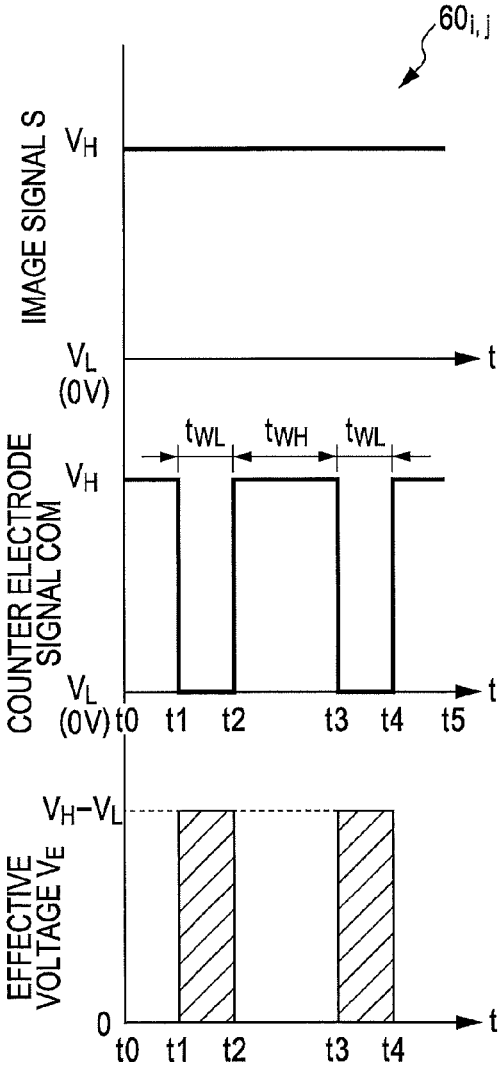
FIGS. 4A and 4B are explanatory views illustrating a driving method of electrophoresis particles.
Figure 4B:
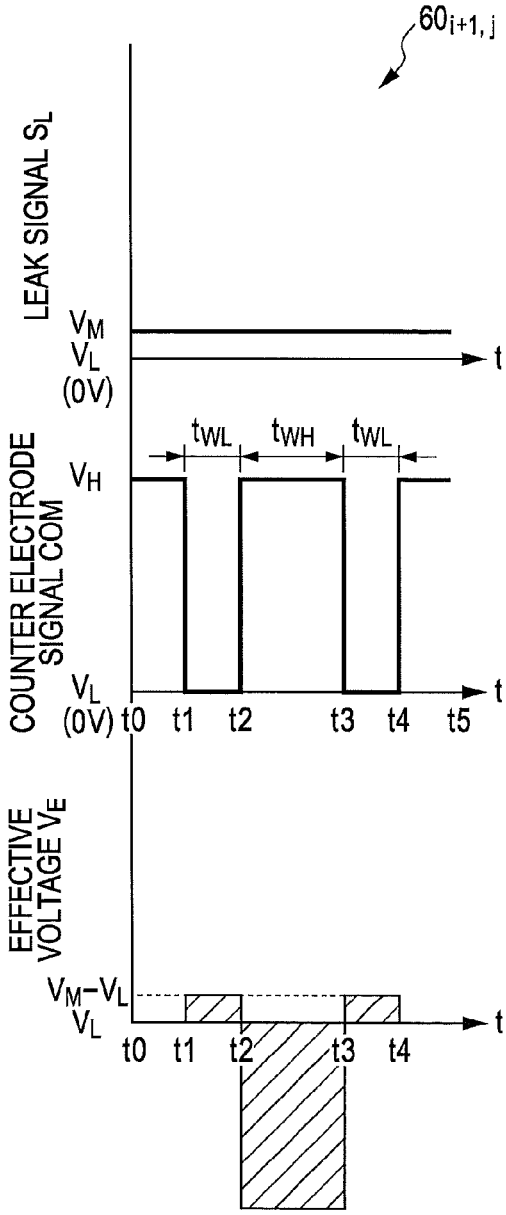

FIGS. 4A and 4B show a driving method of electrophoresis particles. FIG. 4A is a timing chart showing driving voltages in an ON state of the TFT 30 and FIG. 4B is a timing chart showing driving voltages in an OFF state of the TFT 30. In FIGS. 4A and 4B, the voltage on the upper part represents the image signal S supplied to the pixel electrodes, the voltage in the middle part represents the counter electrode signal COM supplied to the counter electrode, and the voltage on the lower part represents an effective voltage $V_E$ applied between the pixel electrode 9 and the counter electrode. The effective voltage $V_E$ is acquired from the potential difference between the image signal S and the counter electrode signal COM. Each of the image signal S and the counter electrode signal COM has two values of a high level potential (H level) $V_H$ and a low level potential (L level) $V_L$. According to this embodiment, the L level potential $V_L$ is a ground potential Gnd (0V) and the H level potential $V_H$ is 40V.

As shown in FIG. 4A, in the case of displaying an image of black, the H level potential $V_H$ is supplied to the pixel electrode as the image signal S. The pulse signal having the same polarity as the image signal S is supplied to the counter electrode during a period between t0 and t1, a period between t2 and t3, and a period between t4 and t5. Accordingly, the effective voltage $V_E$ is supplied between the pixel electrode and the counter electrode during a period between t1 and t2 and a period between t3 and t4. The magnitude of the effective voltage $V_E$ is $V_H$-$V_L$ (>0). Accordingly, the electric field oriented to the counter electrode from the pixel electrode is always formed in the pixels in which the TFTs are in an ON state.

On the other hand, while the image signal is not supplied to the pixel electrodes in the pixels in which the TFTs are in an OFF state in the case of typical display device using general transistors, as shown in FIG. 4B, leak current (off current) which flows in an OFF state is not negligible in the case of the display device using the organic transistors as in this embodiment because the on-off rate is very small. In FIG. 4B, a potential of leak signal $S_L$ supplied to the pixel electrode attributable to the leak current is $V_M$ and the potential $V_M$ is lower than the H level potential $V_H$.

In this state, if the pulse signal is supplied to the counter electrode, the effective voltage $V_E$ having the same polarity as the image signal S is supplied between the pixel electrode and the counter electrode during the period between $t_1$ and $t_2$, the effective voltage $V_E$ having a reverse polarity to the image signal S is supplied between the pixel electrode and the counter electrode during the period between $t_2$ and $t_3$, and the effective voltage $V_E$ having the same polarity as the image signal S is supplied between the pixel electrode and the counter electrode during the period between $t_3$ and $t_4$. The magnitude of the effective voltage $V_E$ applied during the period between t1 and t2 is $V_M$-$V_L$ (>0), the magnitude of the effective voltage $V_E$ applied during the period between $t_2$ and $t_3$ is $-V_H$ (<0), and the magnitude of the effective voltage applied during the period between $t_3$ and $t_4$ is $V_M$-$V_L$ (>0). Accordingly, in the pixels in which the TFTs are in an OFF state, the electric field oriented to the counter electrode from the pixel electrode is formed during the period between $t_1$ and $t_2$, the electric field oriented to the pixel electrode from the counter electrode the pixel electrode is formed during the period between $t_2$ and $t_3$, and the electric field oriented to the counter electrode from the pixel electrode is formed during the period between $t_3$ and $t_4$.

The electric field formed during the period between $t_1$ and $t_2$ and the period between $t_3$ and $t_4$ is a component which must not be essentially formed in the pixels which are in an OFF state. Such electric field acts to move the electrophoresis particles to a position which is different from a position where the electrophoresis particles must exist essentially. Accordingly, this embodiment provides a structure configured in a manner such that the electric field oriented to the pixel electrode from the counter electrode is formed during the period between $t_2$ and $t_3$ by supplying the pulse signal to the counter electrode. By such configuration, even if the electrophoresis particles move to a position different from the position where the electrophoresis particles must exist essentially, it is possible to detain the electrophoresis particles in the position where the electrophoresis particles must essentially exist by the influence of such electric field. In this case, even in the pixels (FIG. 4A) in which the TFTs are in an ON state, movement of the electrophoresis particles is suppressed. However, in the electrophoresis device, although the image signal S is not continuously supplied, the electrophoresis particles continuously move as long as the electric field is formed by the charges accumulated in the pixel electrode. Thus there is no likelihood that movement of the electrophoresis particles is perfectly inhibited (period between $t_2$ and $t_3$ in FIG. 4A) even when supply of the image signal Sis temporarily suspended by the pulse signal.

Figure 5A:
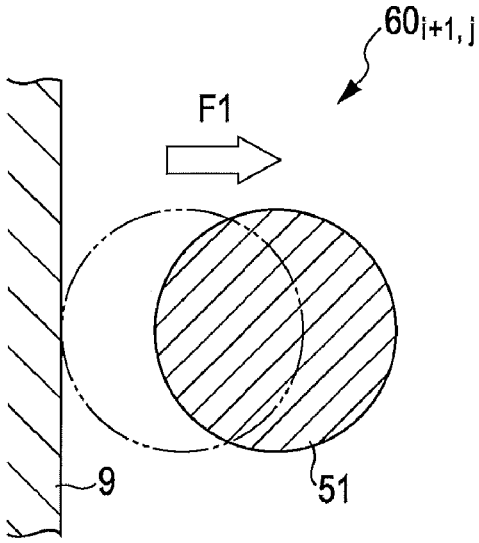
FIGS. 5A and 5B are explanatory views for explaining behavior of the electrophoresis particles in a pixel which is in an OFF state.
Figure 5B:
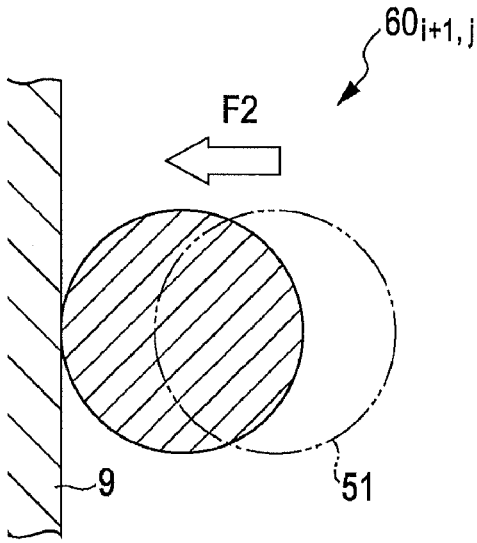

FIGS. 5A and 5B show behavior of electrophoresis particles 51 in the pixels which are in an OFF state. FIG. 5A shows behavior of the electrophoresis particles 51 near the pixel electrode 9 during the period between $t_1$ and $t_2$ and FIG. 5B shows behavior of the electrophoresis particles 51 near the pixel electrode 9 during the period between $t_2$ and $t_3$. In FIGS. 5A and 5B, since it is assumed that the pixels in an OFF state display white, the black electrophoresis particles 51 stick to the surface of the pixel electrode 9 in such pixels.

As shown in FIG. 5A, in the case of displaying the color of black with the pixels in an ON state, the leak signal having the same polarity as the image signal is formed in the pixels in an OFF state, which are electrically connected to the pixels in an ON state via the shared data line. In this case, the electric field oriented to the counter electrode from the pixel electrode 9 is formed during the period between $t_1$ and $t_2$. Accordingly, the electrophoresis particles 51 come to move toward the counter electrode from the position on the pixel electrode 9, where the electrophoresis particles 51 must essentially exist. Force $F_1$ which acts to move the electrophoresis particles 51 is determined by the potential $V_M$ attributable to the off current, and the force $F_1$ which acts to move the electrophoresis particles 51 becomes stronger as the potential $V_M$ becomes larger. Moving distance of the electrophoresis particles 51 is determined by the force $F_1$ and time ($t_2$-$t_1$) for which the force $F_1$ is applied, i.e. the interval $t_{WL}$ between the pulses of the pulse signal supplied to the counter electrode (see FIG. 4).

On the other hand, as shown in FIG. 5B, the electric field oriented to the pixel electrode 9 from the counter electrode is formed during the period between $t_2$ and $t_3$. Accordingly, the electrophoresis particles 51 started to move to the counter electrode move back toward the pixel electrode 9 during the period between $t_2$ and $t_3$. Force $F_2$ which acts to move the electrophoresis particles 51 is determined by the potential difference between the potential $V_H$ of the pulse signal supplied to the counter electrode and the potential $V_M$ of the pixel electrode, which is formed attributable to the off current. The force $F_2$ becomes stronger as the potential difference between the potential $V_H$ and the potential $V_M$ becomes larger. The moving distance of the electrophoresis particles 51 is determined by the force $F_2$ and time ($t_3$-$t_2$) for which the force $F_2$ is applied, i.e. the pulse width $t_{WH}$ of the pulse signal supplied to the counter electrode (see FIG. 4).

As described above, it is preferable that the pulse width $t_{WH}$ of the pulse signal shown in FIG. 4 and the interval $t_{WL}$ between pulses of the pulse signal have the relationship of $t_{WH}<t_{WL}$ from the standpoint of effectively moving the electrophoresis particles in the pixels in an ON state. Conversely, it is preferable that the relationship is $t_{WH}>t_{WL}$ from the standpoint of suppressing undesirable movement of the electrophoresis particles in pixels in an OFF state. In this meaning, the write speed of an image and the contrast of an image are in the tradeoff relationship, and which relationship is given a priority is determined according to requirements of the display device.

Figure 6A:
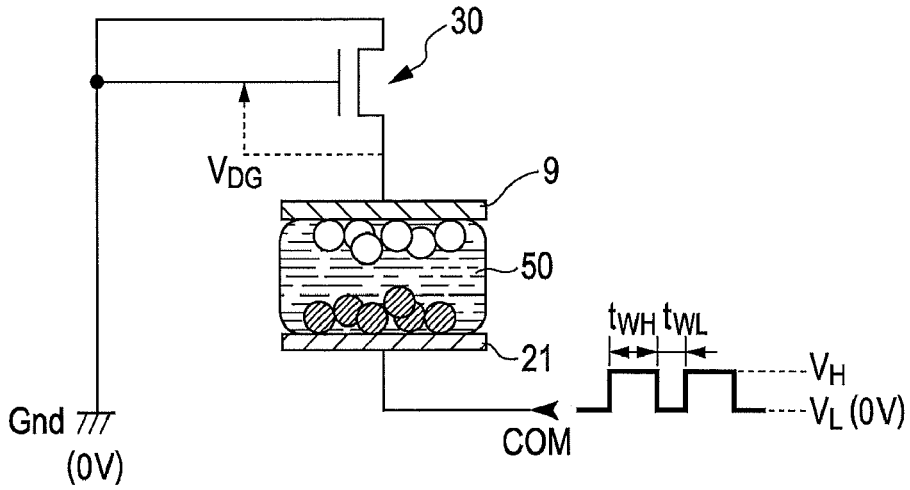
FIGS. 6A and 6B are explanatory views illustrating the relationship between a potential of a gate of a thin film transistor (TFT) and a potential of a pixel electrode.
Figure 6B:
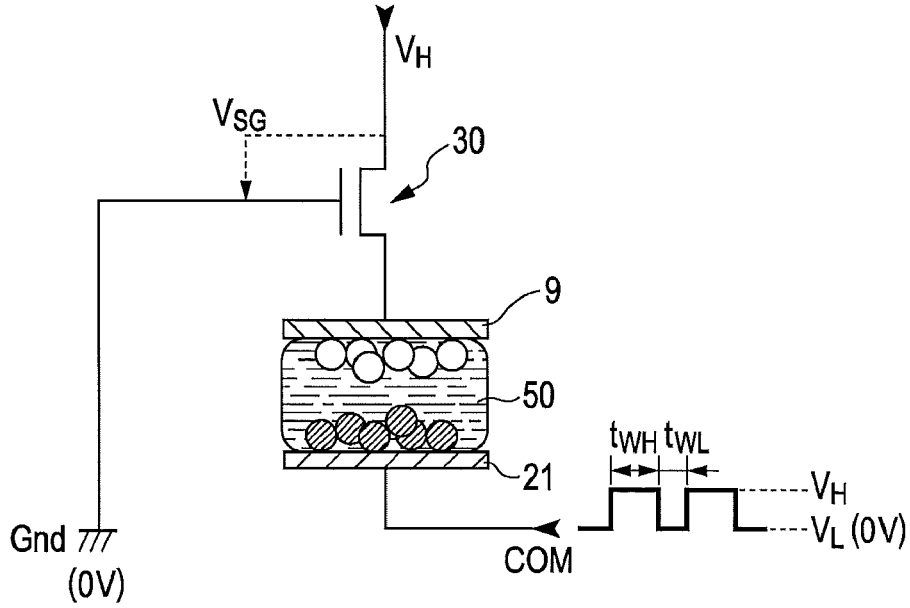

FIGS. 6A and 6B shows equivalent circuits of a pixel in an OFF state and an ON state, respectively for explaining a method of designing the pulse signal. FIG. 5A shows an equivalent circuit of a pixel in an OFF state and FIG. 5B shows an equivalent circuit of a pixel in an OFF state. In order to simplify the description, illustration of the storage capacitors is omitted.

In the case in which the TFT 30 is a P-channel type transistor, in the pixels which perform write operation (the pixels in which the TFTs 30 are in an ON state), the gate bias of the TFT 30 is determined by a potential difference $V_{SG}$ between a ground potential Gnd and a potential applied to a source of the TFT 30. Accordingly, the gate bias of the TFT 30 can be controlled at a predetermined level. On the other hand, in the pixels which do not perform write operation (the pixels in which the TFTs 30 are in an OFF state), the gate bias of the TFT 30 is determined by a potential difference $V_{DG}$ between a ground potential Gnd and a potential attributable to the charges accumulated in the pixel electrode 9. Accordingly, the magnitude of the gate bias changes according to the charges accumulated in the pixel electrode 9. Therefore, the gate bias of the TFTs 30 which do not perform write operation is relatively small, and thus the difference between the gate biases of the TFTs 30 which perform write operation and the TFTs 30 which do not perform write operation is adjusted by setting the interval $t_{WL}$ between the pulses of the pulse signal so as to be larger than the pulse width $t_{WH}$ of the pulse signal.

FIGS. 6A and 6B show the case in which the TFTs 30 are p-channel type transistors, but the condition explained with reference to FIGS. 6A and 6B is also applied to N-channel type transistors in the same manner. In the N-channel type transistors, like the P-channel type transistors, it is preferable that the pulse width $t_{WH}$ of the pulse signal is larger than the interval $t_{WL}$ between the pulses of the pulse signal. With such setting, it is possible to provide a display device having excellent display quality.

As described above, in the electrophoresis device 100 according to this embodiment, since the counter electrode 21 is supplied with the pulse signal having the same polarity as the image signal S, even though the off current flows in the TFT 30, it is possible to draw the electrophoresis particles so as to move in a direction opposite to a direction in which the electrophoresis particles will move by the off current. Accordingly, although the electrophoresis particles are moved to a position which is different from a position where the electrophoresis particles must essentially exist due to the off current of the TFT 30, it is possible to keep the electrophoresis in the position where the electrophoresis particles must essentially exist by influence of the pulse signal. In this case, movement of the electrophoresis particles is suppressed even in the pixels 60 in which the TFTs 30 are in an ON state. However, in the electrophoresis device 100, although the image signal S is not continuously supplied, the electrophoresis particles can continuously move as long as the electric field is formed by the charges accumulated in the pixel electrode 9. Accordingly, although supply of the image signal S is temporarily suspended by the pulse signal, there is no likelihood that movement of the electrophoresis particles is perfectly inhibited. As described above, in the electrophoresis device 100 according to this embodiment, it is possible to prevent the electrophoresis particles from undesirably moving in the pixels 60 in which the TFTs 30 are in an OFF state. Thus, according to this embodiment, it is possible to provide an electrophoresis device having excellent display quality.

In the electrophoresis device 100 according to this embodiment, a plurality of pulse signals are supplied to the counter electrode 21 during a single vertical period V. Accordingly, it is possible to decrease the moving distance of the electrophoresis particles, which is attributable to the off current of the TFTs 30. As described above, the electrophoresis particles move at the time of supplying the image signal S to different pixel electrodes 9 connected with the same data line 6*a*. Accordingly, it is preferable that at least one pulse signal is supplied during the period in which the image signal is supplied to the pixel electrode, i.e. a single vertical period V in order to return the electrophoresis particles to the original position. However, there is a case in which a single time of supply of the pulse signal does not have sufficient effect according to magnitude of the off current. In particular, in a switching element such as an organic transistor having high off current, such a problem may appear notably. Accordingly, in this embodiment, two pulse signals are supplied in a single vertical period V. Thus, it is possible to provide an electrophoresis device having high contrast. Although the number of the pulse signals supplied in a single vertical period V is two, the number of the pulse signals is not limited to two. Alternatively, three or more pulse signals may be supplied in a single vertical period V.

Second Embodiment

Figure 7:
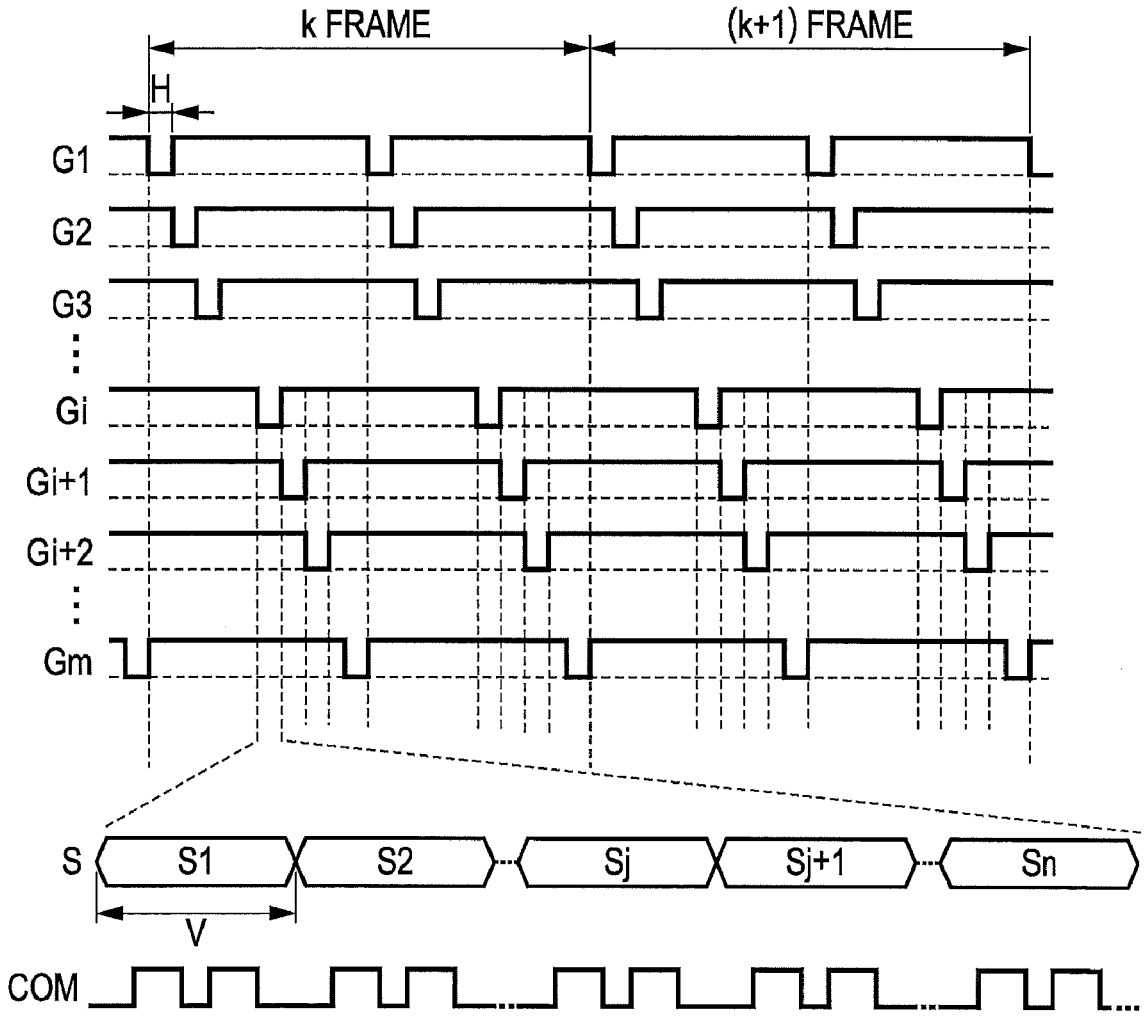
FIG. 7 is a timing chart illustrating a driving voltage according to a second embodiment.

FIG. 7 is a timing chart illustrating driving voltages of an electrophoresis device according to a second embodiment. FIG. 7 corresponds to FIG. 3 according to the first embodiment. This embodiment is different from the first embodiment only in the waveform of the driving signals but is the same as the first embodiment in the structure thereof.

As shown in FIG. 7, in a driving method according to this embodiment, each of the scan lines is scanned two times during a period of one frame (corresponding to 1/60 seconds, in the case of displaying 60 frames in one second). First of all, the first time of scan signals $G_1$, $G_2$, $G_3$, . . . , $G_i$, $G_{i+1}$, $G_{i+2}$, . . . , and $G_m$ are supplied to the first to m-th scan lines, and the first time of image signals $S_1$, $S_2$, . . . , $S_j$, $S_{j+1}$, $S_{j+2}$, . . . , and $S_n$ are supplied to the first to n-th data lines at timings in synchronization with the timings of supply of the scan signals $G_1$, $G_2$, $G_3$, . . . , $G_i$, $G_{i+1}$, $G_{i+2}$, . . . , and $G_m$. Next, the second time of scan signals $G_1$, $G_2$, $G_3$, . . . , $G_i$, $G_{i+1}$, $G_{i+2}$, . . . , and $G_m$ are supplied to the first to m-th scan lines and the second time of image signals $S_1$, $S_2$, . . . , $S_j$, $S_{j+1}$, $S_{j+2}$, . . . , and $S_n$ are supplied to the first to n-th data lines at timings in synchronization with timings of supply of the scan signals $G_1$, $G_2$, $G_3$, . . . , $G_i$, $G_{i+1}$, $G_{i+2}$, . . . , and $G_m$.

In the case of performing two times of scan operation, scan time for each scan operation is shortened, and thus it is possible to decrease the influence of the charge trap which was a problem in the filed of the organic transistors. That is, as for the organic transistors, it is known that a phenomenon called charge trap that current flowing through a transistor decreases as time passes due to migration of opposite charges from a gate electrode to a channel region exists. Since the opposite charges generated by the charge trap is reduced as time passes, it is possible to suppress influence of the charge trap to the minimum by decreasing the scan time for each scan operation and thereby increasing the number of times of scan operation with respect to the scan line.

In this driving method, the image signal is supplied to the pixel every ½ frame. However, even in the case in which the supply of the image signal is performed only for the period of ½ frame and then is suspended, the electrophoresis particles can continuously move by influence of the electric field formed by the charges accumulated in the pixel electrode because charges are accumulated in the pixel electrode just only the first supply of the image signal.

In the case of this embodiment, the image signal is supplied two times during the period of one frame, time of the image signal for each supply is decreased to the half compared with the first embodiment. Accordingly, the supply interval of pulses supplied to the counter electrode is also short compared with the case of the first embodiment. Accordingly, although the electrophoresis particles are moved by the off current of the TFTs, the force of trying to return the electrophoresis particles to its original position will work frequently and, as a result, electrophoresis particles will certainly be fixed to the surface of the electrode.

Figure 8A:
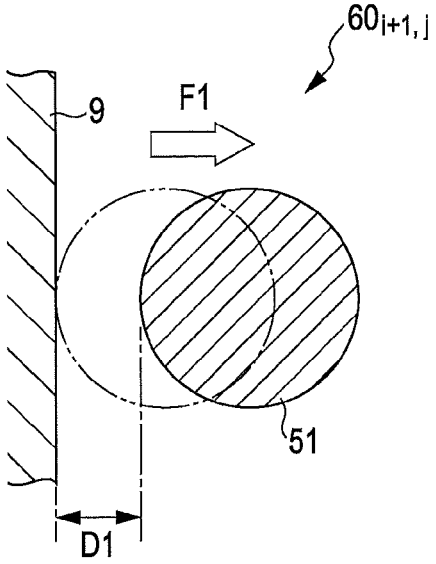
FIGS. 8A and 8B explanatory views illustrating behavior if electrophoresis particles in a pixel which is in an OFF state.
Figure 8B:
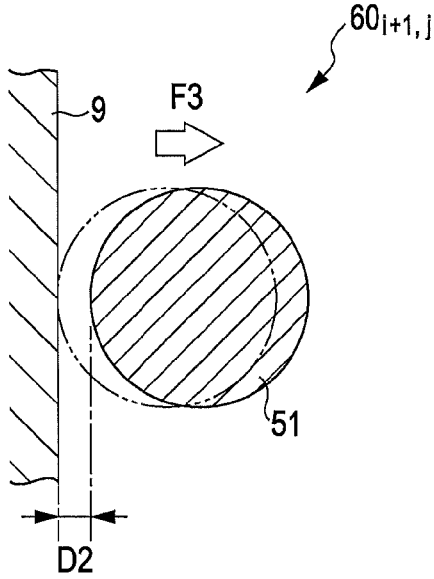

FIGS. 8A and 8B show behavior of the electrophoresis particles 51 in the pixels in an OFF state. FIG. 8A shows the case (an example of the first embodiment) in which the number of scan operations performed in the period of one frame is set to be one and FIG. 8B shows the case (an example of this embodiment) in which two times of scan operations are performed in the period of one frame. In FIGS. 8A and 8B, it is assumed that the pixels in an OFF state display the color of white, and thus the black electrophoresis particles 51 stick to the surface of the pixel electrodes 9.

As shown in FIG. 8A, in the case in which the number of scan operations with respect to each scan line is set to be one, the supply interval of the pulse signals supplied to the counter electrode becomes the period of one frame. Accordingly, the electrophoresis particles 51 in the pixels in an OFF state move in a direction getting away from the pixel electrode 9 by a moving distance D1 during the period of one frame due to influence of the off current of the TFT. On the other hand, as shown in FIG. 8B, in the case in which the number of scan operations is set to two, the supply interval of the pulse signals supplied to the counter electrode becomes the period of ½ frame, and thus moving distance of the electrophoresis particles 51 in the pixels in an OFF state is decreased to about the half (distance D2) of the moving distance of the case shown in FIG. 8A. Accordingly, deterioration of the contrast is suppressed and thus it is possible to provide a display device having excellent display quality.

As described above, in the electrophoresis device according to this embodiment, each of the scan lines is scanned two times in a period of one frame, and thus it is possible to suppress movement of the electrophoresis particles attributable to the off current of the TFT to the minimum. Further, influence of the charge trap of the organic transistor is decreased and thus it is possible to provide a display device which performs write operation at high speed. Although the number of scan operations to each of the scan lines is set to be two in this embodiment, the number of scan operations is not limited thereto. As the number of scan operations becomes larger, the above described effect becomes greater. Accordingly, the number of scan operations can be increased to three or more.

Electronic Apparatus

Figure 9:
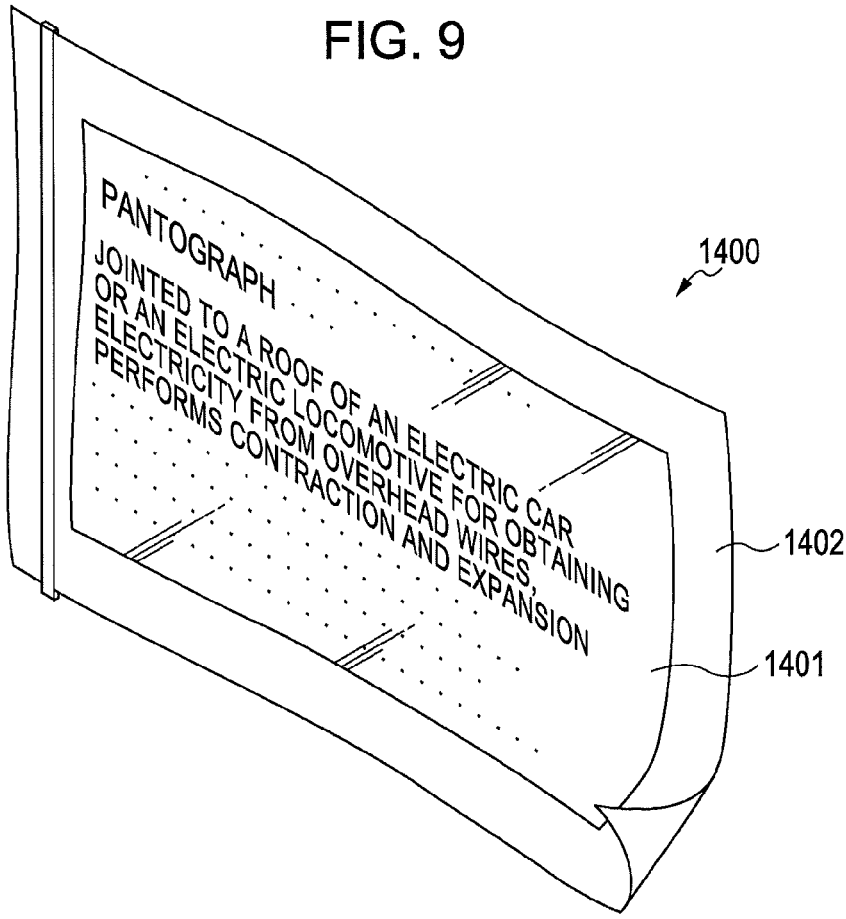
FIG. 9 is a schematic view illustrating electronic paper which is an example of an electronic apparatus.

FIG. 9 shows an electronic paper 1400 which is an electronic apparatus including the display device of the invention. The electronic paper 1400 includes a display section 1401 in which the electrophoresis device according to the above-described embodiment is mounted, and a main body 1402 in the form of a rewritable sheet having the paper-like texture and flexibility. Applications of the display device of the invention are not limited to the electronic paper but can be various electronic apparatuses. Examples of the electronic apparatus include an electronic book, a personal computer, a digital still camera, a liquid crystal television, a view finder type, or a monitor direct-viewing type videotape recorder, a car navigation apparatus, a pager, an electronic notebook, a calculator, a word processor, a workstation, a TV phone, a POS terminal, and various apparatuses equipped with a touch panel. The display device can be properly used as a display means in such electronic apparatuses.

What is claimed is:

1. A display device comprising:

a pixel electrode and a counter electrode facing each other;

a plurality of charged particles disposed between the pixel electrode and the counter electrode;

an organic transistor electrically connected to the pixel electrode;

a data line electrically connected to the pixel electrode via the organic transistor;

a data line driving circuit supplying an image signal to the pixel electrode through the data line;

a scan line electrically connected to the pixel electrode via the organic transistor;

a scan line driving circuit supplying a scan signal to the organic transistor through the scan line; and a counter electrode driving circuit supplying a counter electrode driving signal containing first and second pulse signals to the counter electrode, wherein the first and second pulse signals have the same polarity as the image signal, the counter electrode driving circuit supplies the first and second pulse signals to the counter electrode during a supplying period in which the scan line driving circuit supplies one of the scan signal, and first and second pulse widths of the first and second pulse signals, respectively, are larger than an interval period between the first pulse signal and the second pulse signal.

2. The display device according to claim 1, wherein the image signal has an amplitude that is the same as that of the first and second pulse signals.

3. The display device according to claim 1, wherein the scan line driving circuit scans the scan line a plurality of times during a period of one frame.

4. An electronic apparatus comprising the display device according to claim 1.

5. A driving method of a display device in which a plurality of charged electrophoresis particles are disposed between a plurality of pixel electrodes and a counter electrode and in which an image is displayed by moving the charged electrophoresis particles by electric field formed between the plurality of pixel electrodes and the counter electrode, comprising:

supplying an image signal to first and second pixel electrodes of the plurality of pixel electrodes via first and second organic transistors, respectively;

supplying a scan signal to the first and second organic transistors; and supplying a counter electrode driving signal containing first and second pulse signals to the counter electrode while supplying the image signal to the plurality of pixel electrodes, wherein the first and second pulse signals have the same polarity as the image signal, the counter electrode driving circuit supplies the first and second pulse signals to the counter electrode during a supplying period in which one of the scan signal is supplied, first and second pulse widths of the first and second pulse signals, respectively, are larger than an interval period between the first pulse signal and the second pulse signal, when first organic transistor is an OFF state and when the second organic transistor is an ON state, the electric field applied to the charged electrophoresis particles, which are disposed between the second pixel electrode and the counter electrode, is in a first direction from the second pixel electrode to the counter electrode during the interval period, and when first organic transistor is an OFF state and when the second organic transistor is an ON state, the electric field applied to the charged electrophoresis particles, which are disposed between the first pixel electrode and the counter electrode, is in a second direction from the counter electrode to the first pixel electrode during the supplying period, and the first direction and the second direction are opposite to each other.

6. The driving method of a display device according to claim 5, wherein the image signal has an amplitude that is the same as that of the first and second pulse signals.

* * * * *